United States Patent [19]

Bumüller et al.

[11] Patent Number: 4,622,728

[45] Date of Patent: Nov. 18, 1986

[54] METHOD AND APPARATUS FOR SHRINKPROOFING TUBULAR FABRIC

[75] Inventors: Lothar Bumüller, Rielasingen/Worblingen; Alfred Engelmann, Moos; Franz Kille; Alfred Maier, both of Radolfzell; Otto Scharf; Fritz Wörner, both of Radolfzell, all of Fed. Rep. of Germany

[73] Assignee: Fleissner GmbH & Company, Egelsbach, Fed. Rep. of Germany

[21] Appl. No.: 535,702

[22] Filed: Sep. 26, 1983

[30] Foreign Application Priority Data

Sep. 25, 1982 [DE] Fed. Rep. of Germany ..... 3235555

[51] Int. Cl.[4] ..... D06C 5/00

[52] U.S. Cl. ..... 26/18.5; 26/84

[58] Field of Search ..... 26/18.5, 18.6, 22, 25–27, 26/51, 51.3, 75–78, 80–90, 106, 2 R; 34/159, 164, 207, 62, 67, 115; 68/DIG. 1, DIG. 5

[56] References Cited

U.S. PATENT DOCUMENTS

| | | | |
|---|---|---|---|
| 781,145 | 1/1905 | Jahr | 34/159 |
| 2,439,722 | 4/1948 | Dneisel | 26/18.5 |
| 2,441,357 | 5/1948 | Hibbert | 34/67 |
| 2,597,530 | 5/1952 | Redman | 26/18.5 |
| 2,826,167 | 3/1958 | Cohn et al. | 26/84 |
| 3,102,006 | 8/1963 | Cohn et al. | 26/18.5 |
| 3,175,272 | 3/1965 | Cohn et al. | 26/84 |
| 3,204,317 | 9/1965 | Hurt et al. | 26/84 |
| 3,406,462 | 10/1968 | Fleissner | 34/115 |
| 3,469,423 | 9/1969 | Fleissner | 68/DIG. 5 |
| 3,584,392 | 6/1971 | Alexeff | 34/159 |
| 3,594,914 | 7/1971 | Rayon | 34/172 |
| 3,698,049 | 10/1972 | Fleissner | 26/18.5 |
| 3,783,526 | 1/1974 | Fleissner | 34/12 |
| 3,811,159 | 5/1974 | Cecere | 26/86 |
| 3,891,389 | 6/1975 | Verburg et al. | 8/405 |
| 3,943,613 | 3/1976 | Schraud et al. | 28/18.5 |
| 4,219,942 | 9/1980 | Coliva | 34/164 |
| 4,562,627 | 1/1986 | Milligan | 26/81 |

FOREIGN PATENT DOCUMENTS

| | | | |
|---|---|---|---|
| 474508 | 6/1951 | Canada | 34/164 |
| 1936111 | 1/1971 | Fed. Rep. of Germany . | |
| 2850570 | 6/1980 | Fed. Rep. of Germany . | |
| 2951295 | 6/1981 | Fed. Rep. of Germany . | |
| 356579 | 12/1905 | France | 34/159 |
| 791431 | 12/1935 | France | 26/86 |
| 1458135 | 4/1967 | France . | |
| 2229798 | 12/1974 | France . | |
| 0078747 | 5/1983 | France . | |
| 0173366 | 10/1984 | Japan | 26/18.5 |
| 7900977 | 5/1980 | PCT Int'l Appl. . | |
| 552780 | 8/1974 | Switzerland . | |
| 495785 | 11/1938 | United Kingdom | 26/56 |
| 997447 | 7/1965 | United Kingdom . | |
| 2054684 | 2/1981 | United Kingdom . | |

*Primary Examiner*—Robert R. Mackey
*Assistant Examiner*—Joseph S. Machuga
*Attorney, Agent, or Firm*—Antonelli, Terry & Wands

[57] ABSTRACT

A continuous method for shrinkproofing tubular fabric, especially knitted and the like goods, is effected so that the fabric is spread when wet, then compressed lengthwise and then dried in a shrinkproof manner. This method provides for overstretching the fabric more than 130%, preferably even 160%, widthwise, overfeeding the fabric uniformly lengthwise while stretching and spreading the fabric, and immediately thereafter, in a relaxing fashion, drying the fabric continuously and in finished form with brief alternating movements under the influence of heat. During this heat treatment, the shrinkage potential produced is completely eliminated, with the meshes of the fabric moving into a stable position which no longer results in a change during domestic washing or tumble drying. It is important for the economics of the method for the fabric first to be pre-dried to about 20%, and then to be treated as described. The apparatus for working the method includes a spreader, which has a tooth-shaped drive unit for reliable conveyance of the fabric tube to each of two spreader arms.

43 Claims, 6 Drawing Figures

Fig.4
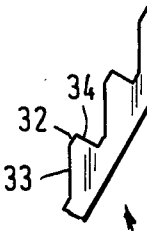
Fig.3
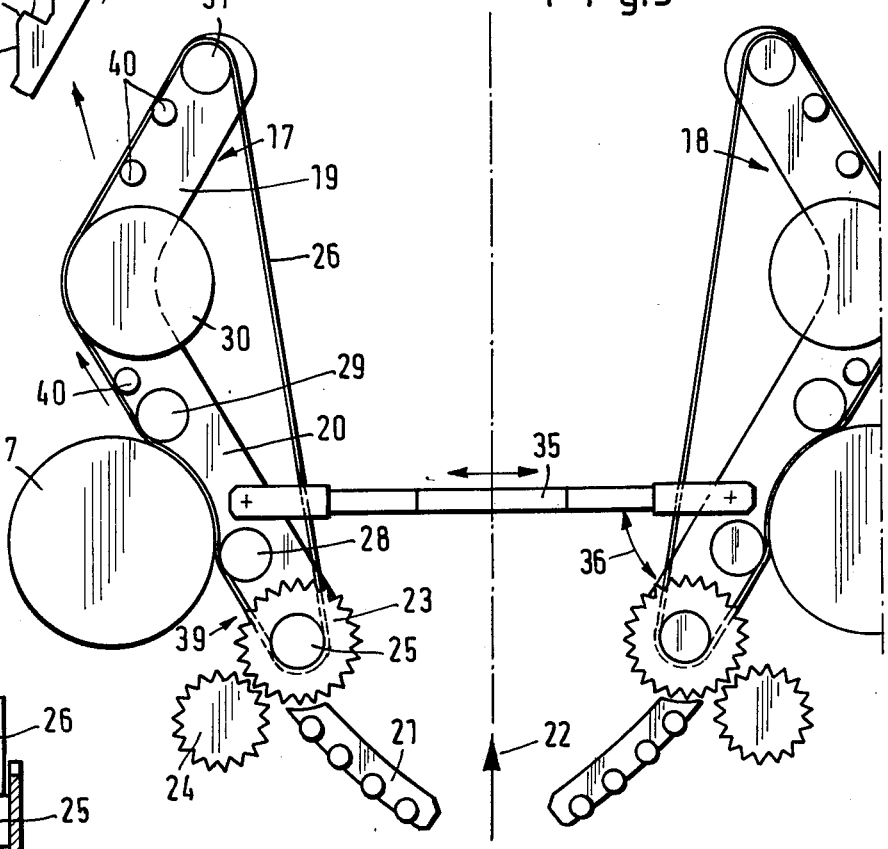
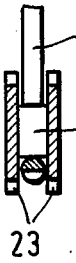
Fig.5
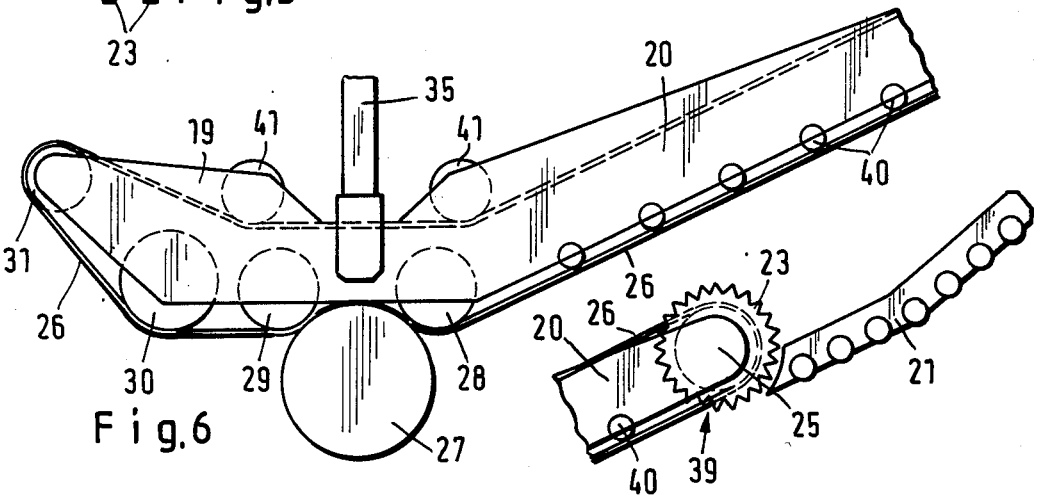
Fig.6

METHOD AND APPARATUS FOR SHRINKPROOFING TUBULAR FABRIC

The invention relates to a method of shrinkproofing tubular fabric, such as hosiery or knitted goods, in which the fabric is subjected to a wet treatment, spread out while wet, and then dried, free of tension, and an apparatus for carrying out this method.

A method of this type is known from German OS No. 19 36 111. In this patent publication, the tubular fabric, after being merely squeezed, is stretched to a maximum of 70% of its initial width and then compressed mechanically lengthwise in preparation for shrink treatment to be performed in a perforated cage drier located downstream. In addition to the compressing device disclosed in this German patent publication, composed of two perforated drums rotating in opposite directions, under suction, and driven at different rotational speeds, mechanical compression according to U.S. Pat. No. 3,452,409, is also known in the form of a compressing device with the aid of which the knitted fabric can be compressed to a maximum of 33%.

Knitted goods of all types have become popular because of their highly positive wearing characteristics such as flexibility, pliability, stretchability, and adaptability. However, these characteristics, which are advantageous in use, create problems in knitting during manufacture and during the subsequent finishing of knitted goods. Knitted goods by contrast to woven goods are readily deformable, and are, therefore, sensitive to distortion and unstable in their dimensions. This disadvantage does not apply to knitted goods made from manmade fibers, whose dimensions can be permanently fixed by a hot air process. This is not true for knitted goods made of natural fibers, which are used extensively for knitted goods in the textile industry because of their known advantageous properties such as absorbency.

In particular, when domestic tumble driers are used, it has been found that knitted clothing undergoes considerable changes in its dimensions after this drying process. This is not disadvantageous as far as the width of the clothing is concerned, because the products have sufficient stretchability in this direction. However, a dimensional change in the lengthwise direction is disadvantageous and can amount to as much as 20%. The reason for this dimensional instability is the latent stresses produced in the knitted goods during manufacture. Such a shrinkage potential occurs during knitting, especially in finishing, for example, in bleaching, squeezing, and drying.

Many ideas have been put forth regarding production of dimensional stability in knitted goods made of natural fibers. The wide variety of these ideas will be apparent in particular from the article by Ulrich Koch in the periodical "Wirkerei-und Strickerei-Technik," No. 6, 1982, pp. 514–525. In all of the measures involved, the economics of the process are as important as the effect achieved. This eliminates all the discontinuous types of processing such as dry relaxation, in which the fabric must be stored for more than four weeks, without external stress, to reduce shrinkage (Ulrich Koch, op. cit, p. 526, 5.3). The frequently employed mechanical shortening of the length of the goods by forcibly compressing together the mesh in the lengthwise direction by means of compressing devices that act against one another (U.S. Pat. No. 3,452,409) can also be eliminated from consideration. It is true that these methods can compress the mesh to a maximum of 30%, but the surface quality, volume of the goods, and feel of the mesh goods suffers as a consequence of this treatment.

Hence, the goal of a successful treatment should be a process in which the natural mesh configuration of the knitted goods is created approximately, under the influence of the mesh itself. To achieve this goal, continuous tumble driers have been developed which are at least partially successful but only in cases in which high shrink potentials exist. It has been found that such driers only permit shrinkage results not extending beyond 4%. It is important, however, to achieve a shrinkage value in excess of 10%, so that investing in such driers make no sense because more can be achieved in finishing by using an appropriate treatment that protects the material.

For reasons of economy, it is also necessary to disregard the discontinuous process; namely, the use of wet storage machines (German AS No. 10 47 398). Devices of this kind are admittedly necessary in preparing a multi-web drying process downstream from the driers, advantageous for shrink treatment, for dewatering the fabric, washed, for example, after which the tube, which comes in a continuous strand out of the drier, is stored wet in the form of a tube that is stretched to less than 100% of its dimensions, and is then put into the perforated drum drier. With continuously operating installations, however, this process does not fit into the assembly line where the tubes come directly out of the finishing line and into the drier. This does away with the wet storage process, so that the possible advantage of being able to compensate for any distortions in the tubing must be lost (Ulrich Koch, op. cit., p. 523, 6.5).

For the sake of economy and also for the desired degree of success, it is not satisfactory if, as proposed (Ulrich Koch, op. cit., p. 524, 7) the wet storage machine that suffers from these disadvantages is, nevertheless, used and the fabric, following the known overstretching process, is finally dried in a drier only to 35% residual moisture, in order then to be placed in a shrinking machine in which the drying is completed. In this way, tests have shown that shrinkage values of 3% can be achieved, but this is only sufficient if only a slight shrinkage potential exists because of the previous manufacture and finishing of the tubing. This is not possible, however, with continuous machinery of the type in use today.

On the basis of the process described hereinabove, the goal of the invention is to develop a method and an apparatus by means of which a tubular fabric made of natural fibers is treated, which is optimally stabilized in its dimensions, but which still has a bulky feel and a good surface quality, and at the same time can be manufactured economically; such a type of mesh fabric undergoes no significant lengthwise shrinkage even with repeated washing and tumble drying.

On the basis of the method described at the outset, it is contemplated by this invention to stretch the knitted fabric more than 130%, and while stretching and spreading the fabric, to overfeed it uniformly lengthwise and immediately afterwards to finish drying it continuously under the influence of heat in a relaxing fashion with movement that changes at short intervals.

In the method according to this invention, it has been found especially advantageous for the fabric to be stretched to 160–180%. It can be advantageous to bring back the tube to a width of 140% overstretch on the stretching frame, in order then to be dried while being shaken or vibrated. Shaking should be done in a continuous drier than no stress whatever on the fabric. In fact, drying is so stress-free that the hot process air necessary for final drying should not be directed against the fabric and, hence, against the endless belt, in order to prevent the resultant increase in friction between the fabric and the conveyor belt. In addition, no blast of air should be directed at the fabric from below, since this air can also cause a partial stretching effect. Itis much more advantageous to let the air merely blow across the fabric in order to carry away the resultant moist air.

During finish-drying, the tubing which has been overfed about 10%, is subjected to a strong shaking movement which can have, for example, a frequency of 13 Hz. Heat treatment should last from 1.5 to 3 minutes at a temperature of preferably 130°–150° C., so that there are 400–2,400 shaking movements in the course of the finish-drying. Finally, the dimensions that result are fixed by a cooling device or unit.

In the method according to the invention, it is especially advantageous for the fabric to be dried initially in a stress-free manner to slightly below a moisture content of 30% by weight and only the treated as described.

Predrying a web-form fabric to less than 25% for subsequent transverse stretching inside a stretching frame and fixing this stretched state in a subsequent perforated drum drier is known from German OS No. 17 60 151. This process and the method of this invention are not comparable to each other, however, because the German OS No. 17 60 151 provides for fixing a stretched state achieved by transverse stretching during drying, while the method according to the invention, achieves the opposite; namely, completely eliminating once again the width status of the tube in the drier produced by stretching, and causing the tubing to shrink lengthwise.

One essential feature of the method according to the invention, is the extreme overstretching of the tubing, previously not considered possible, by means of a spreader of a type known, per se. In order to achieve this extreme overstretching, however, a gear drive is provided on each of the spreader arms of the spreaders, according to the invention, for constant feed of the tubing over the previously set width of the spreader. It is advantageous if, for example the conveyor belts known from German OS No. 28 29 008, which are round in cross-section and positioned on each of the spreader arms, are provided with outwardly directed cam-shaped teeth and revolve together with a gear provided at the inlet of the spreader; the gear having a higher circumferential velocity at the outer circumference than that of the conveyor belt which is applied to a hub of the gear, so that the knitted tubing is fed to the cams of the conveyor belt with an overfeed of approximately 1:2.

The drawing shows the apparatus for conducting the method and two embodiments of a spreader unit. The following detailed description will describe additional inventive features of the method and the apparatus according to the invention.

FIG. 3 is an enlarged top view of a spreader;

FIG. 4 shows the belt conveyor shown in FIG. 3 in an enlarged view;

FIG. 5 shows a cross-sectional view of a gear conveyor shown in FIG. 3; and FIG. 6 shows one of the spreader arms with a partially modified design.

Figure 1:
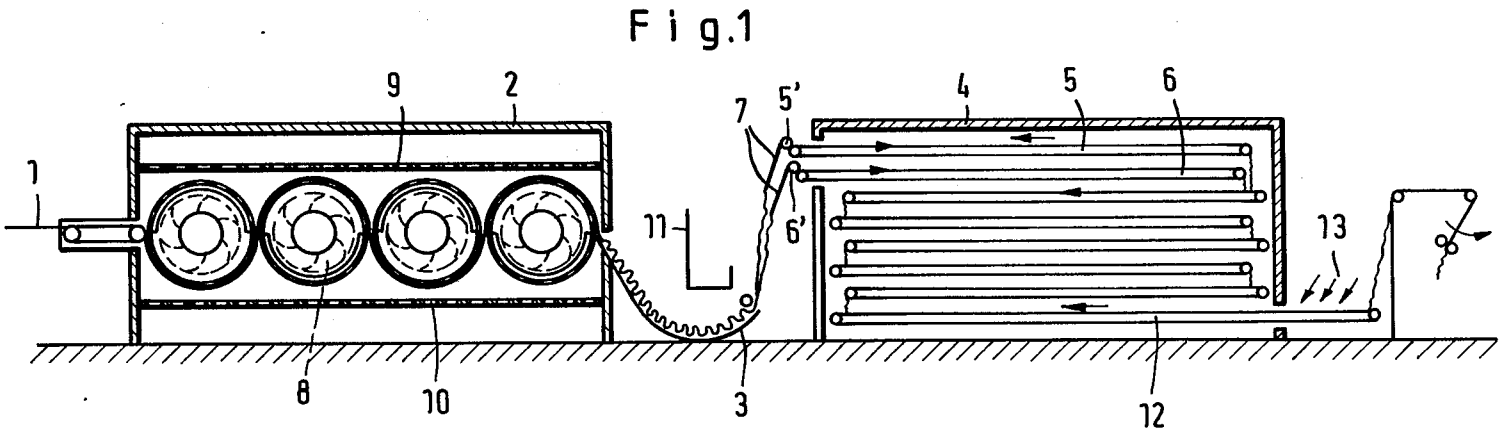
FIG. 1 is a longitudinal elevational view of a continuous arrangement for shrinkproofing tubing with a continuous agitator.

The arrangement for shrinkproofing knitted tubing or tubes 1, arranged in several flattened webs side by side, consists of a sieve; i.e., perforated, drum drier 2, a holding tank 3 connected thereto, and a multilevel belt drier 4, with uppermost belts 5, 6 that receive the tubing spread out by spreader 7 shown in FIG. 3.

The sieve drum drier 2 has a known design. It consists of four perforated drums; i.e., sieve drums, around which fabric 1 passes in a meander-shaped path. The drums are covered internally on the circumferential surface, which is not covered by the fabric, so that the drums at these locations are impermeable to a suction draft, and at one of the ends of the drums, in a separate fan chamber, fans 8, represented in the drawing by dashed lines, are provided to generate a vacuum inside each sieve drum. The process air is then blown upward and downward by the fan and then recycled through perforated covers or sheets 9 and 10 into a processing chamber in which the drums are located.

When the knitted tubes, which move side by side through the drier, emerge from drier 2, they are dried down to a moisture content of about 20%; the tubes then enter storage tank 3, from which they are pulled by powered spreaders 7. For observation of the operation of the spreaders, a catwalk 11 is provided at a suitable height for the operator. A plurality of spreaders 7 is disposed side by side; e.g., in two planes, one for each tube. Since the tubes are to be overstretched more than 100%, it is advantageous to dispose the spreaders in staggered fashion separated by gaps, alternating between different levels, and to place them on the corresponding in-feeding endless belts 5 and 6 of the drier 4 which has beater means for shaking or vibrating the tubes. A feed roller 5', 6' is disposed in front of and slightly above belts 5, 6 in order to lay the tubes on endless belts 5, 6 with a slight overfeeding of about 10%.

The drier 4 is designed as a multistage belt drier and consists of a plurality of endless belts disposed parallel to one another from one end of which the heat-treated tubes are shifted to an endless belt circulating in the opposite direction and located beneath. The two uppermost endless belts 5, 6 move in the same direction in order to provide sufficient space widthwise for the overstretched tubes. After initial shrinkage is complete, one endless belt suffices to receive all the tubes moving side by side. Each of the endless belts is preferably provided with only one rotary beater 14, 14' disposed beneath a corresponding upper run 15 for delivering rhythmic blows as the beater rotates against the corresponding endless belt, with a belt deflection between 30 to 70 mm and preferably 50–60 mm. The rotary beaters can have any suitable design. It is advantageous to provide rollers that contact the endless belt 15 and that are provided either on a beater 14 itself or as elements 37 of a connecting rod 38, moved up and down by a rotating cam 14'. This arrangement makes it possible to adjust the belt deflection easily.

Figure 2:
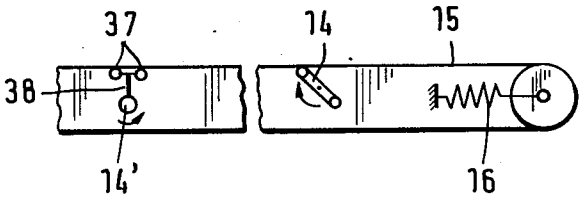
FIG. 2 is an enlargement of a detail of the shaking drier shown in FIG. 1.

The endless belt should be in the form of a lightweight articulated belt and should be supported under adjustable spring tension 16 to at least one deflection point as shown in FIG. 2, so that the stresses in the endless belt produced by the shaking movements can be reduced. The bottommost endless belt 12 carries the tubes outside the drier 4, on which belt the tubes are cooled by means of cooling air 13 or the like blown down upon the tubes and then the tubes are removed. The moist air produced during final drying is carried away by hot air blown parallel over the endless belts, the air being guided in a countercurrent manner as indicated by the arrows shown within unit 4. Heating devices are provided in the drier to heat the drying air to 100°–150° C., preferably 130°–150° C., the heating devices not being shown in the drawing. The unsaturated drying air used in shaking is then fed as fresh air to perforated drum drier 2.

FIGS. 3 and 6 show the spreader represented in FIG. 1 by reference numeral 7. The spreader consists of two spreader arms 17, 18 bent inward toward the middle of each tube. Two arm sections 19 and 20, directed away from each other at obtuse angles, are provided, each having an additional inwardly directed extension arm 21 at its feed end. The tubes of knitted fabric to be overstretched is guided through the spreader in the direction of arrow 22.

In order to accomplish considerable stretching, continuous feed of the knitted fabric by means of toothed drive means is provided. A powered rotating gear 23 is provided at the inlet, and its teeth have flanks of about 60°. The matching gear 24 rotates at a distance, and is not powered. However, this gear can also be powered to produce variable advance of the fabric, while gear 23 rotates loosely. For power, gear 23 is provided at the center with a hub 25 whose diameter is smaller than the outer circumference of gear 23, as shown in FIG. 5. The advance can be set as a function of the diameter of this hub 25. This hub 25 is engaged by an endlessly circulating conveyor belt 26, powered externally by drive roller 27. Conveyor belt 26, therefore, passes around gear 23, drive wheel 27 which abuts support rollers 28, 29, and finally idler wheel 30 provided at the widest point on the spreader, and idler wheel 31 which is provided at the upper end of the spreader arm. From this point, conveyor belt 26 returns to gear 23.

In addition to the gear drive means using gears 23 and 24, conveyor belt 26 is also provided with outwardly directed saw-tooth shaped teeth 32, as shown in FIG. 4. Conveyor belt 26 is round in cross-section and has these saw-tooth-shaped cams 32 on the side that supports the fabric. They are provided firstly with a gently rising flank 33 in the feed direction of the fabric and secondly with a steeply dropping flank 34. The tube is gripped in small folds in the angle between the steeper flank 34 and the gentler flank 33, depending on the advance set on gear 23, 25. The tooth-shaped depressions in the conveyor belt need not follow one another directly as shown in FIG. 4, but can also be provided in belt 26 at short intervals. On its way from the feed end of the spreader at the level of gear 23 to the widest point at idler wheel 30, the tube is uniformly stretched 200–180%. The increased width results from the length of the tubing which is available because of the uniform folding which takes place at tooth flanks 34 and 33. The advance produced at point 39 on conveyor belt 26 should be set so that the folds, which are fed in at deflecting wheel 30, are actually and fully taken up.

The two spreader arms 17, 18 are held apart by a connecting rod 35. This rod has an adjustable length so that any desirable overstretching of the knitted goods; i.e., the tubes, can be set. Connecting rod 35 is articulated to spreader arms 17 and 18 in front of the widest point; namely, in front of idler wheel 30, and locked there nonrotatably to the spreader arms. Angle 36 between arm 20 and connecting rod 35 is adjustable so that this adjustment also can be used to set the maximum width or delivery width of the tube from spreader 7. Spreader arm 19 can also be pivotably linked to arm 20.

Only one spreader arm 17' is shown in FIG. 6, the other spreader arm has been omitted. The construction of this embodiment is similar to that in FIG. 3. However, arm section 20 is stretched much further away from drive roller 27 in order to stretch the tubing slowly and extensively. For exact guidance of conveyor belt 26, additional support rollers 40 are rotatably mounted on arm section 20 so that belt 26 is not forced into a curve by the increasing transverse pull when it approaches support rollers 28, 39. Here, too, the return of the conveyor belt is accomplished differently with two loosely turning return rollers 41 serving to return conveyor belt 26 closer to the spreader arm at the level of support rollers 28, 29.

We claim:

1. A method for shrinkproofing tubular fabric, especially knitted goods, wherein the fabric is subjected to a wet treatment, spread while wet, then dried in a tension-free manner, characterized in that the fabric is pre-dried to have a moisture content less than 30% by weight; the pre-dried fabric is overstretched more than 130%, based on the width of the finished fabric material on a spreader means having conveyor means provided with teeth for positively engaging the fabric to effect advancement of the fabric during overstretching of more than 130%, the fabric is overfed uniformly lengthwise onto the spreader means as the fabric is overstretched on said spreader means, and then the overstretched fabric is finish-dried continuously in a hot air drier under the action of heat in a relaxed state with shaking movements being imparted to the fabric.

2. A method according to claim 1, characterized in that the fabric is overstretched by more than 160%.

3. A method according to claim 2, characterized in that the fabric is overstretched by 160–180%.

4. A method according to claim 2, characterized in that the fabric is spread to 2.6–2.8 times its original width and emerges with a final width of about 140% overstretching.

5. A method according to claim 1, characterized in that overfeeding amounts to more than 70%.

6. A method according to claim 1, characterized in that movement of the fabric during final drying is in the form of a completely unimpeded shaking motion.

7. A method according to claim 6, characterized in that the shaking movement has a frequency of approximately 13 Hz and a travel of about 30–70 mm.

8. A method according to claim 7, characterized in that the heat treatment is carried out at a temperature of 100°–160° C.

9. A method according to claim 8, characterized in that drying air alone serves to carry away moisture from the fabric in the hot air drier; said drying air being directed parallel to and over the shaking fabric.

10. A method according to claim 9, characterized in that the dry air passes several times, on both sides, over the shaking fabric.

11. A method according to claim 6, characterized in that the duration of the heat treatment to effect final drying, depending on the weight of the fabric, is 1.5 to 3 minutes.

12. A method according to claim 1, characterized in that the fabric is successively pre-dried under zero tension to slightly less than 30% moisture, based on the weight of the fabric, then stretched and finally finish-dried in a relaxing fashion.

13. A method according to claim 12, characterized in that the fabric is pre-dried to 15–25%.

14. A method according to claim 13, characterized in that pre-drying the tubular fabric is accomplished by means of the fabric resting on the outside of a permeable support without any stress, with a drying gas passing through the fabric from the outside to the inside by the effect of suction created within the permeable support.

15. A method according to claim 1, characterized in that the finish-dried fabric is cooled outside of the hot air drier before the fabric is transported to storage.

16. A method according to claim 1, characterized in that treatment of the fabric is accomplished simultaneously on a plurality of tubular webs running side by side.

17. An apparatus for shrinkproofing tubular fabric which comprises storage means for retaining at least a portion of one continuous length of tubular fabric having a predetermined moisture content, means for overfeeding the at least one tubular fabric lengthwise in a uniform manner, a spreader means for over-stretching the width of the at least one tubular fabric while the fabric is overfed and a shaker drier means located downstream from the spreader means for simultaneously shaking and drying the over-stretched fabric; said shaker drier means including at least one conveyor belt on which the tubular fabric is conveyed in a relaxed state; said spreader means including conveyor means having teeth for positively engaging the tubular fabric and for continuously advancing the overstretched fabric onto the at least one conveyor belt; and said means for overfeeding the at least one tubular fabric lengthwise including drive means equipped with teeth for engaging the tubular fabric and for overfeeding the tubular fabric onto said conveyor means.

18. An apparatus according to claim 17, characterized in that the shaker drier comprises a multistage belt drier equipped with means for shaking the fabric during transportation along each run of a belt and with means for directing a heat gaseous medium over said fabric to effect drying.

19. An apparatus according to claim 18, characterized in that the means for directing a heated medium comprises fan means for providing ventilation uniformly over and parallel to the working width of individual belts arranged one above the other within said drier.

20. An apparaus according to claim 17, characterized in that at least two belts running side-by-side in the same direction are provided for conveying a plurality of tubular fabrics into and through a first stage of the multistage belt drier and that a single belt located directly beneath the two belts moving in the opposite direction, is provided for receiving all pre-shrunk tubular fabrics.

21. An apparatus according to claim 20, characterized in that a plurality of spreader means are associated in at least two planes with said at least two feed belts.

22. An apparatus according to claim 17, characterized in that an upward and downward movement of each endless belt is caused by a rotary beater striking a load-carrying run of the endless belt from below.

23. An apparatus according to claim 22, characterized in that a rotary beater is applied via rollers sliding against the load-carrying run.

24. An apparatus according to claim 22, characterized in that the beating force of the beaters against the load-carrying run is adjustable.

25. An apparatus according to claim 22, characterized in that endless belt comprises a lightweight, articulated rod belt.

26. An apparaus according to claim 17, characterized in that a drier for predrying a plurality of tubular fabrics arranged in parallel is positioned upstream of said spreader means.

27. An apparatus for shrinkproofing tubular fabric which comprises storage means for retaining at least a portion of one continuous length of tubular fabric having a predetermined moisture content, means for overfeeding the at least one tubular fabric lengthwise in a uniform manner, a spreader means for over-stretching the width of the at least one tubular fabric while the fabric is overfed and a shaker drier means located downstream from the spreader means for simultaneously shaking and drying the over-stretched fabric; the spreader means comprising two spreader arms arranged with an adjustable distance between them, on each arm a pair of rollers rotatably mounted, between and against which a powered circulating drive roller is applied externally under pressure, and a conveyor belt having a circular cross-section passing around the roller pair and the drive roller for effecting uniform forward movement of a spread tubular fabric, and said means for overfeeding the at least one tubular fabric lengthwise including a tooth-shaped drive means provided on an intake end of each of the spreader arms to move a spread open tubular fabric onto the spreader arms and the conveyor belt with an overfeed.

28. An apparatus according to claim 27, characterized in that the conveyor belt is provided with outwardly directed saw-tooth shaped teeth.

29. An apparatus according to claim 28, characterized in that the teeth, viewed in the feed direction, are provided initially with a gently sloping flank portion and then with a steeply inclined flank portion, said steeply inclined flank portion extending substantially perpendicular to the travel direction of the belt.

30. An apparatus according to claim 27, characterized in that the conveyor belt circulates in parallel with a feed gear at the level of the intake end of a spreader arm.

31. An apparatus according to claim 30, characterized in that said feed gear is driven by the conveyor belt.

32. An apparatus according to claim 31, characterized in that the feed gear is provided with a hub which is small relative to its outside diameter, with which hub the conveyor belt engages in a driving fashion.

33. An apparatus according to claim 32, characterized in that assembly of the feed gear and hub is designed to be of adjustable diameter, depending on the desired advance of the fabric.

34. An apparatus according to claim 32, characterized in that the feed gear consists of two gear whels located at a distance from one another and separated by the hub.

35. An apparatus according to claim 30, characterized in that a matching gear which engages the feed gear with play is associated with the feed gear externally beyond the tubular fabric to be spread.

36. An apparatus according to claim 35, characterized in that the matching gear rotates loosely.

37. An apparatus according to claim 35, characterized in that feed gear is mounted to rotate freely and matching gear rotates under power.

38. An apparatus according to claim 27, characterized in that each of the spreader arms is bent inwardly in the direction of the center of the tubular fabric.

39. An apparatus according to claim 38, characterized in that both spreader arms are nonrotatably connected by a connecting rod provided for width adjustment of said spreader means.

40. An apparatus according to claim 39, characterized in that the connecting point between connecting rod and a spreader arm is provided at a location other than the widest point of each spreader arm.

41. An apparatus according to claim 39, characterized in that an angle between connecting rod and each of the spreader arms is adjustable.

42. An apparatus according to claim 27, characterized in that each of the spreader arms consists of two arm sections directed away from one another at an obtuse angle and to the feed end of which a feed gear is guided and over whose total length a toothed belt is guided by rollers.

43. An apparatus according to claim 42, characterized in that the spreader arm is extended beyond the feed gear by an inwardly directed extension arm with at least one feed roller.

* * * * *